US006162344A

United States Patent [19]

Reid et al.

[11] Patent Number: 6,162,344

[45] **Date of Patent: *Dec. 19, 2000**

[54] METHOD OF ELECTROPLATING SEMICONDUCTOR WAFER USING VARIABLE CURRENTS AND MASS TRANSFER TO OBTAIN UNIFORM PLATED LAYER

[75] Inventors: Jonathan D. Reid, Sherwood; Robert J. Contolini, Lake Oswego; Edward C. Opocensky, Aloah; Evan E. Patton, Portland; Eliot K. Broadbent, Beaverton, all of Oreg.

[73] Assignee: Novellus Systems, Inc., San Jose, Calif.

[ * ] Notice: This patent is subject to a terminal disclaimer.

[21] Appl. No.: 09/393,226

[22] Filed: Sep. 9, 1999

Related U.S. Application Data

[62] Division of application No. 09/121,174, Jul. 22, 1998, Pat. No. 6,074,544.

[51] Int. Cl.[7] ..... C25D 7/12; C25D 5/00

[52] U.S. Cl. ..... 205/157; 205/96

[58] Field of Search ..... 205/157, 96

[56] References Cited

U.S. PATENT DOCUMENTS

| | | | |
|---|---|---|---|
| 4,065,374 | 12/1977 | Asami et al. | 204/228 |
| 4,304,461 | 12/1981 | Grandia et al. | 204/23 |
| 4,624,749 | 11/1986 | Black et al. | 204/15 |
| 5,437,777 | 8/1995 | Kishi | 204/224 R |
| 5,670,034 | 9/1997 | Lowery | 205/143 |
| 5,744,019 | 4/1998 | Ang | 205/96 |
| 5,873,992 | 2/1999 | Glezen et al. | 205/159 |

FOREIGN PATENT DOCUMENTS 57-73953 5/1982 Japan .

*Primary Examiner*—Edna Wong
*Attorney, Agent, or Firm*—Skjerven Morrill MacPherson LLP; David E. Steuber

[57] ABSTRACT

In electroplating a metal layer on a semiconductor wafer, the resistive voltage drop between the edge of the wafer, where the electrical terminal is located, and center of the wafer causes the plating rate to be greater at the edge than at the center. As a result of this so-called "terminal effect", the plated layer tends to be concave. This problem is overcome by first setting the current at a relatively low level until the plated layer is sufficiently thick that the resistive drop is negligible, and then increasing the current to improve the plating rate. Alternatively, the portion of the layer produced at the higher current can be made slightly convex to compensate for the concave shape of the portion of the layer produced at the lower current. This is done by reducing the mass transfer of the electroplating solution near the edge of the wafer to the point that the electroplating process is mass transfer limited in that region. As a result, the portion of the layer formed under these conditions is thinner near the edge of the wafer.

9 Claims, 4 Drawing Sheets

METHOD OF ELECTROPLATING SEMICONDUCTOR WAFER USING VARIABLE CURRENTS AND MASS TRANSFER TO OBTAIN UNIFORM PLATED LAYER

This is a divisional application of U.S. Ser. No. 09/121,174 filed Jul. 22, 1998, now U.S. Pat. No. 6,074,544, now issued on Jun. 13, 2000.

BACKGROUND OF THE INVENTION

In the semiconductor industry, metal layers may be deposited on semiconductor wafers by electroplating processes. The layers are formed of such metals as gold, copper, tin and tin-lead alloys, and they typically range in thickness from 0.5 to 50 microns. The general nature of the process is well-known. The wafer is immersed in an electrolytic bath containing metal ions and is biased as the cathode in an electric circuit. With the solution biased positively, the metal ions become current carriers which flow towards and are deposited on the surface of the wafer.

There are several criteria that need to be satisfied in such a system. First, the thickness of the layer must be as uniform as possible. Second, the layer is often deposited on a surface which has narrow trenches and other circuitry features that must be completely filled, without any voids. Third, for economic reasons the layer must be formed as rapidly as possible.

Assuming that the metal is to be deposited on a nonconductive material such as silicon, a metal "seed" layer, typically 0.02 to 0.2 microns thick, must initially be deposited, for example by physical or chemical vapor deposition, before the electroplating process can begin. The electrical contacts to the wafer are normally made at its edge. Therefore, since the seed layer is very thin, there is a significant resistive drop between the points of contact on the edge of the wafer and the center of the wafer. This is sometimes referred to as the "terminal effect". Assuming that the system is operating in a regime where the plating rate is determined by the magnitude of the current, the plating rate is greater at the edge of the wafer than at the center of the wafer. As a result, the plated layer has a concave, dish-shaped profile. Once the seed layer has been built up by the plated layer, the terminal effect diminishes and the plated layer is deposited at a more uniform rate, although the top surface of the plated layer retains its dish-shaped profile.

One factor which influences the plating rate and thickness profile is the rate at which the metal ions move near the surface of the wafer, often referred to as the "mass transfer rate". When the mass transfer rate is high and the current level is low, all areas of the surface of the wafer are supplied with an ample quantity of ions, and the mass transfer rate has no effect on the thickness profile of the layer. Conversely, when the mass transfer rate is low and the current is high, the mass transfer of the metal ions to the wafer surface becomes the critical factor in determining the rate at which the metal is deposited. The process is then called "mass transfer limited". In this situation, variations in the rate of mass transfer from one point to another on the wafer surface will produce corresponding variations in the plating rate. For example, if the rate of mass transfer at the center of the wafer is high compared to that near the edge of the wafer, the deposited layer can be expected to have a greater thickness at the center of the wafer than near its edge.

The ability of the plated layer to fill features in the underlying surface generally depends on the size of the plating current. In most cases, there is an optimum current for filling features of a given size and aspect ratio with a given metal. For example, if filling is ideal at a current density of 15 mA/cm$^2$, the initial plating should proceed at that current density.

The terminal effect can be overcome by the use of insulating shields which shift the current away from the portions of the wafer nearest to the electrical contacts. Such shields are described, for example, in U.S. Pat. No. 3,862,891 to Smith and U.S. Pat. No. 4,879,007 to Wong.

The problem with using shields is that they remain in place even after the thickness of the metal layer has increased to the point where the terminal effect is no longer present.

Accordingly, there is a clear need for a technique which overcomes the terminal effect and has good feature filling qualities yet allows the metal layer to be plated at a rapid rate.

SUMMARY

In accordance with this invention, a metal layer is deposited on a semiconductor wafer by a method which comprises immersing the wafer in an electrolytic solution containing metal ions; depositing a seed layer on a surface of the wafer; biasing the wafer negatively with respect to the electrolytic solution so as to create a current flow at a first current density between the electrolytic solution and the wafer and thereby deposit a metal layer electrolytically on the wafer; and, after the metal layer has reached a predetermined thickness and resistivity, increasing the current flow to a second current density greater than the first current density.

The degree to which the terminal effect influences the thickness profile depends on the plating rate or the size of the current used. A high initial current creates a larger resistive drop and thus a much higher plating rate near the edge of the wafer as compared to the center of the wafer. By using a current at the first current density, the resistive drop between the edge of the wafer and the center of the wafer is reduced, and this reduces the difference between the deposition rate at the edge of the wafer as compared with the deposition rate at the center of the wafer.

When the metal layer has reached the predetermined thickness at which the resistive drop between the edge of the wafer and the center of the wafer has been reduced to an acceptable level, the current flow can be increased to the second current density without creating an unacceptable difference in the deposition rate at the edge of the wafer as compared with the deposition rate at the center of the wafer. The increase in the current density can be obtained by stepping the current upward in one or more discrete steps or by "ramping" the current gradually upward. In addition, a combination of one or more steps and one or more ramps can also be employed.

In a second embodiment of this invention the process also involves two stages. In a first stage, a first metal sublayer is deposited on the seed layer at a current density and other conditions which yield a sublayer having a concave top surface as a result of the edge effect. In the second stage, the conditions in the electrolytic bath are adjusted such that the deposition process is mass transfer limited in the area near the edge of the wafer. This can be accomplished, for example, by reducing the mass transfer rate of the solution near the edge of the wafer and/or increasing the current density. In these conditions, the deposition rate (and typically the mass transfer rate) is greater adjacent the interior of the wafer than near the edge of the wafer, and this offsets or compensates for the concave top surface of the first sublayer such that the top surface of the composite of the first and second sublayers is flat to a high degree.

According to another aspect of the invention, the current is initially set at a density such that trenches or other features on the surface of the wafer are effectively filled without voids. Once the features have been filled, the current density and/or mass transfer rate can be varied as described above to minimize the terminal effect while being combined in a way which increases the overall plating rate. Note that the features may occur in the semiconductor wafer itself or in oxide or other layers deposited or otherwise formed on the surface of the semiconductor wafer. As used herein, unless the context requires a different construction, the terms "semiconductor wafer" or "wafer" include the semiconductor material as well as any such layers formed over the semiconductor material.

Thus, according to this invention, variations in the thickness profile of an electroplated layer on a semiconductor wafer that arise from the terminal effect can be minimized or eliminated by a relatively inexpensive process sequence.

BRIEF DESCRIPTION OF THE DRAWINGS

The invention is best understood by reference to the follow drawings, in which.

DESCRIPTION OF THE INVENTION

Figure 1:
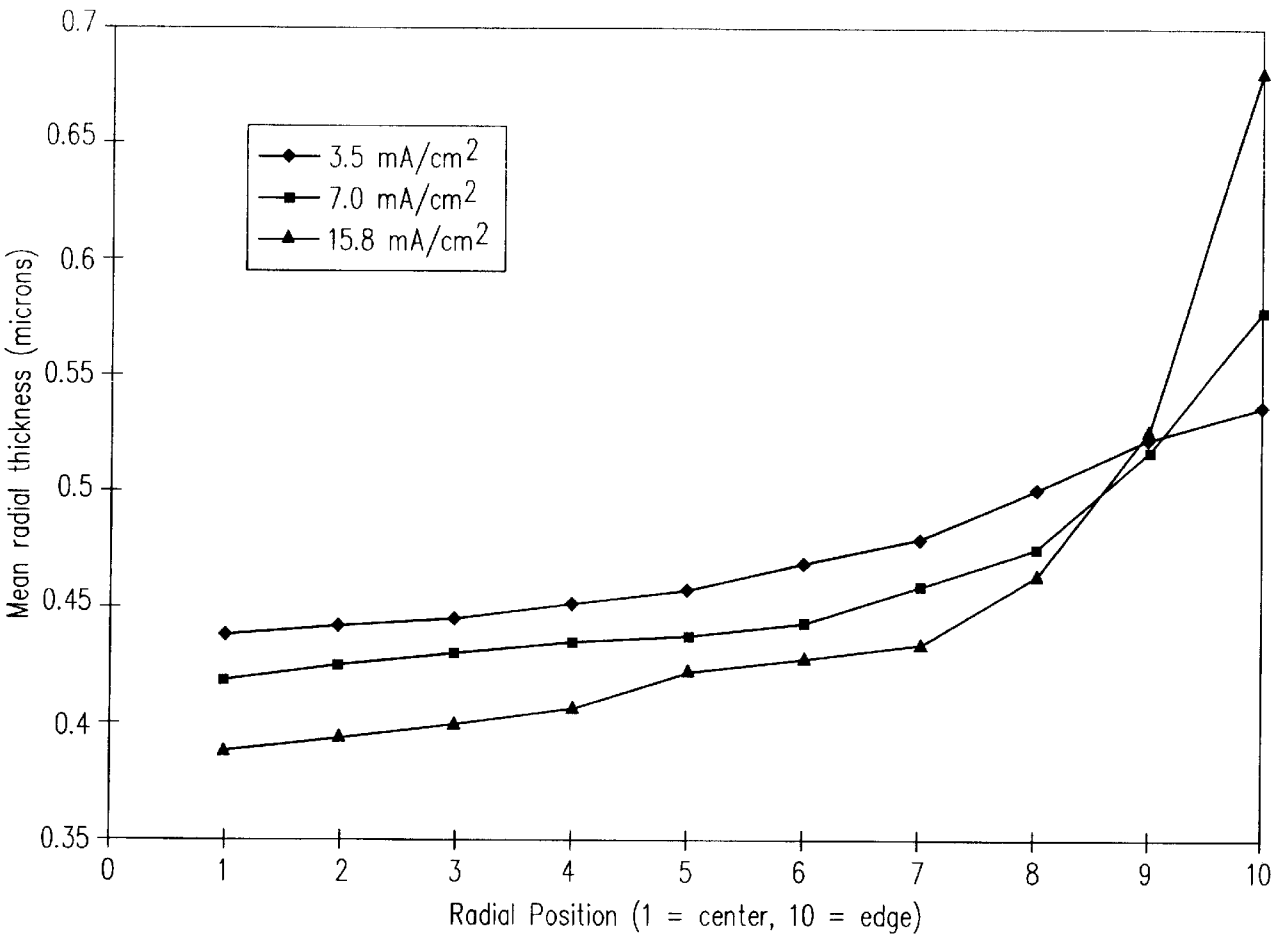
FIG. 1 (PRIOR ART)
FIG. 1 is a graph showing the thickness profiles of conventional electroplated layers formed at different current levels.

FIG. 1 shows a thickness profile and in particular the terminal effect for a layer of copper electroplated on a 8-inch wafer to a nominal plated thickness of 5000 Å. On the horizontal axis the numeral "1" represents the center of the wafer and the numeral "10" represents the edge of the wafer. The electroplating was performed with a SABRE Electrofill plating unit, available from Novellus Systems, Inc. of San Jose, Calif. This unit is similar to the electroplating system described in U.S. application Ser. No. 08/969,984, filed Nov. 13, 1997, which is incorporated herein by reference in its entirety. The electroplating solution was an aqueous acid copper solution consisting of $Cu^{++}$ions (17 gm/l), $H_2SO_4$ (170 gm/l), $Cl^-$ions (60 ppm) and SELREX CUBATH M solution. The flow rate was 2 GPM and the bath was maintained at 22° C. and the wafer was rotated at 100 RPM.

The electroplated copper layer was deposited on a copper seed layer that was deposited by physical vapor deposition (PVD) to a thickness of 430 Å over a tantalum barrier layer. The tantalum barrier layer was deposited, also by PVD, on a silicon substrate.

As indicated, three current levels were tested, with current densities of: 3.5 mA/cm$^2$, 7.0 mA/cm$^2$ and 15.8 MA/cm$^2$. In all cases, as a result of the terminal effect, the thickness of the layer was greater at the edge of the wafer. With the low 3.5 mA/cm$^2$ current the difference in thickness was only about 0.05 microns, whereas with the high 15.8 mA/cm$^2$ current the difference was over 0.25 microns, or more than one-half the nominal thickness of the layer. Clearly, from the standpoint of the thickness profile alone it would be preferable to use the low current. However, it took 4.5 times longer to deposit the 5000 Å layer with the low current than with the high current. In many cases this additional time would represent an unacceptable loss of throughput.

Figure 2:
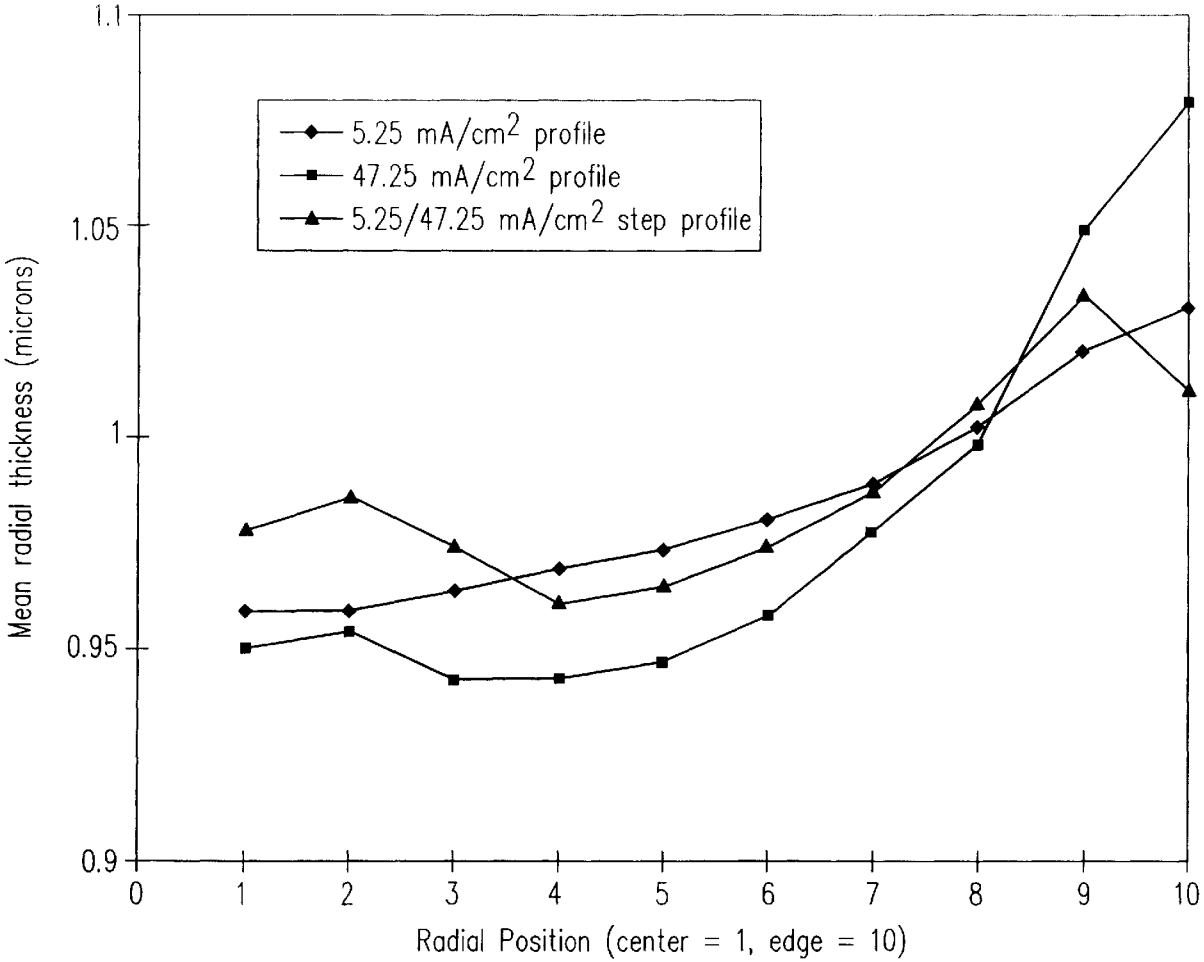
FIG. 2 is a graph showing the thickness profile of an electroplated layer formed using a stepped current in accordance with this invention as compared to the thickness profiles of layers formed in accordance with conventional constant current processes.

FIG. 2 shows the thickness profile of a copper layer formed to a nominal thickness of 1 micron on the same equipment. The layer was formed on a copper seed layer of 400 Å that was deposited by PVD. The wafer was rotated at 150 RPM and the electroplating bath was recirculated at 4 GPM. Three currents were tested: a constant current having a density of 5.25 mA/cm$^2$, a constant current having a density of 47.25 mA/cm$^2$, and a current which was initially at a density of 5.25 mA/cm$^2$ and after 120 seconds was stepped upward to a density of 47.25 mA/cm$^2$ and maintained at that level for an additional 40 seconds. The layer was 0.25 microns thick when it was stepped, and an additional 0.75 microns of thickness was added at the higher current density.

In general, the edge effect substantially disappears when the combined thickness of the seed layer and the plated layer produce a sheet resistance that is in the range of 0.06 to 0.12 ohms/square. For copper, this normally occurs when the thickness of the combined seed and plated layer reaches 0.20 to 0.40 microns.

As expected, the profile of the layer formed at the high 47.25 mA/cm$^2$ current shows a sharp increase in thickness near the edge of the wafer. The profile of the layer formed at the low 5.25 mA/cm$^2$ current is quite flat but the layer took 480 seconds to form. The thickness of the layer formed with the stepped current varies overall by approximately the same amount as the low current layer (although the distribution profile is somewhat changed), but the time required to deposit the layer with the stepped current was only 160 seconds. Thus, using a stepped current produced a plated layer whose thickness uniformity compared favorably with the low current layer in substantially less time.

An alternative technique is to accept some concavity at the lower current but vary the conditions such that the layer deposited at the higher current has a profile which is slightly convex (i.e., somewhat thinner at the edge). These two conditions (concave lower layer, convex upper layer) can offset each other and produce a composite plated layer that is flat to a high degree. One way of producing a convex layer at the higher current is to limit the mass transfer of the electrolytic solution near the edge of the wafer. As described above, the deposition process becomes "mass transfer limited" when there is an insufficient supply of metal ions to maintain the plating rate that would otherwise prevail at the existing process conditions. A convex upper layer can also be produced by varying the electric field with a shield or thief, as is known in the art.

The mass transfer rate is a function of the flow of the electroplating solution, the rotation rate of the wafer, and geometry of the tank in which the wafer is immersed and of the fixture which is used to hold the wafer. For example, a fixture geometry that produces a low rate of mass transfer near the edge of the wafer can be used to form a convex upper layer that will compensate for a concave lower layer resulting from the terminal effect.

Figure 3:
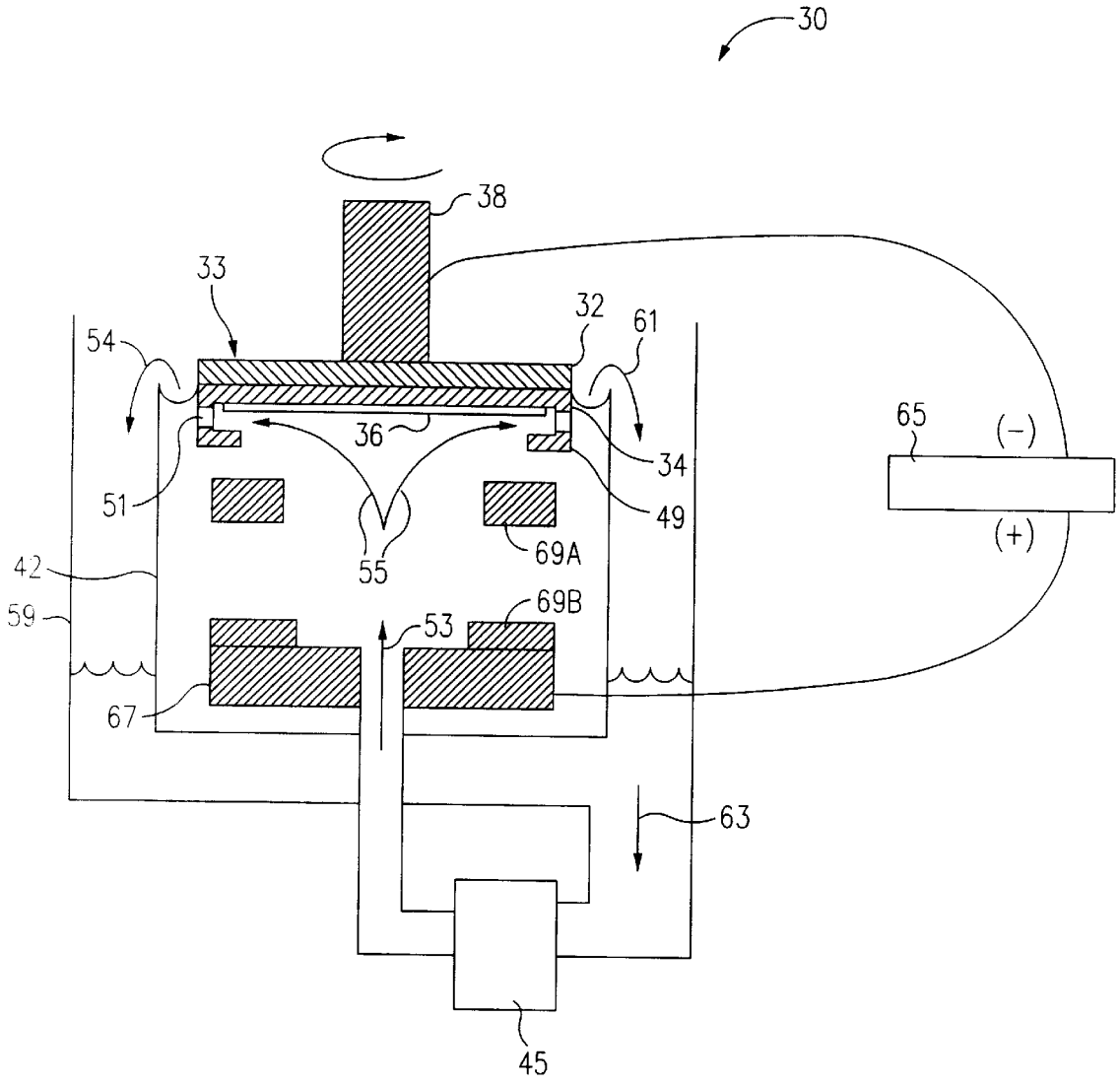
FIG. 3 is a cross-sectional view of an electroplating apparatus that can be used to produce reduced mass transfer near the edge of a wafer.

The apparatus described in the above-referenced U.S. application Ser. No. 08/969,984, shown in FIG. 3, can be used to produce reduced mass transfer near the edge of the wafer. FIG. 3 is a cross-sectional view of an electroplating apparatus 30 having a wafer 36 mounted therein. Apparatus 30 includes a clamshell 33 mounted on a rotatable spindle 38 which allows rotation of clamshell 33. Clamshell 33 comprises a cone 32, a cup 34 and a flange 49. Flange 49 has formed therein a plurality of apertures 51. A flange similar to flange 49 is described in detail in U.S. application Ser. No. 08/970,120, filed Nov. 13, 1997, which is incorporated by reference herein.

During the electroplating cycle, wafer 36 is mounted in cup 34. Clamshell 33 and hence wafer 36 are then placed in a plating bath 42 containing a plating solution. As indicated by arrow 53, the plating solution is continually provided to plating bath 42 by a pump 45. Generally, the plating solution flows upwards to the center of wafer 36 and then radially outward and across wafer 36 through apertures 51 as indicated by arrows 55. The plating solution then overflows plating bath 42 to an overflow reservoir 59 as indicated by arrows 54, 61. The plating solution is then filtered (not shown) and returned to pump 45 as indicated by arrow 63 completing the recirculation of the plating solution.

A DC power supply 65 has a negative output lead electrically connected to wafer 36 through one or more slip rings, brushes and contacts (not shown). The positive output lead of power supply 65 is electrically connected to an anode 67 located in plating bath 42. Shields 69A and 69B are provided to shape the electric field between anode 67 and wafer 36. Reduced mass transfer at the edge of the wafer 36 is produced by the flange 49 which extends down and slightly over the edge of the wafer 36 and which creates a stagnant zone of solution near the edge of the wafer 36, apparently because solution moves along with the clamshell in this region as opposed to moving rapidly across the surface of the wafer (due to the rotation) in the interior portions of the wafer 36. The degree of mass transfer reduction can be adjusted by varying the sizes of the apertures 51 shown in FIG. 3.

Figure 4:
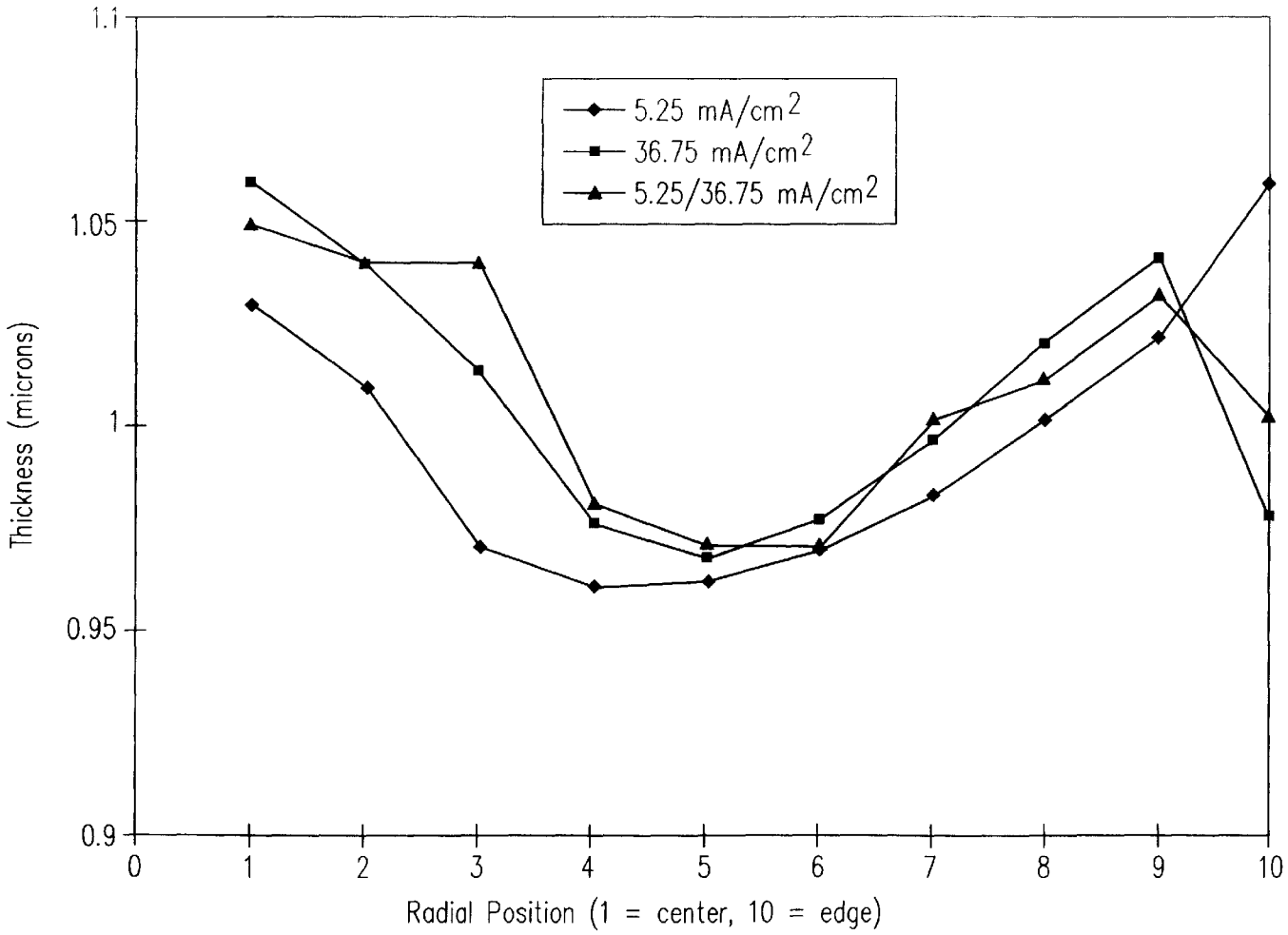
FIG. 4 is a graph showing the thickness profiles of, respectively, a layer formed at a low current, a layer formed at a high current using a process which is mass transfer limited at the edge of the wafer, and a composite of the foregoing layers.

FIG. 4 shows the thickness profiles of a layer plated at a current density of 5.25 mA/cm$^2$, a layer plated at a current density of 36.75 mA/cm$^2$ where the deposition at the edge of the wafer was mass transfer limited, and a composite layer which includes a lower sublayer formed at the conditions of the 5.25 mA/cm$^2$ layer and an upper sublayer formed at the conditions of the 36.75 mA/cm$^2$ layer. The plating was performed at a flow rate of 1.0 GPM and at a wafer rotation rate of 50 RPM on a copper seed layer 400 Å thick. Each layer was deposited to a nominal thickness of 1 micron. The composite layer was formed by applying the 5.25 mA/cm$^2$ current for 85 seconds until the lower sublayer reached a nominal thickness of 0.18 $\mu$ and then applying the 36.75 mA/cm$^2$ current for 55 seconds until the upper sublayer reached a thickness of 0.82$\mu$.

As is evident, the thickness of the upper sublayer fell off markedly near the edge of the wafer, thereby offsetting the concave shape of the lower sublayer. The profile of the composite layer is more uniform than the profile of any layer formed at any constant current between 5.25 mA/cm$^2$ and 36.75 mA/cm$^2$ and was deposited in the same time as a layer formed at a constant current of 16.75 mA/cm$^2$. The low and high currents used in this embodiment of the invention may be at any levels, but it has been found that the best results for copper deposition are obtained when the low current is between 5.25 mA/cm$^2$ and 16.75 mA/cm$^2$ and the high current is between 33.5 mA/cm$^2$ and 60 mA/cm$^2$.

The foregoing embodiments are intended to be illustrative and not limiting. Numerous additional embodiments in accordance with the broad principles of this invention will be apparent to persons skilled in the art.

We claim:

1. A method of depositing a metal layer on a semiconductor wafer comprising:

depositing a seed layer on a surface of the wafer;

immersing the wafer in a bath containing an electrolytic solution containing metal ions;

biasing the wafer negatively with respect to the electrolytic solution so as to create a current flow at a first current density between the electrolytic solution and the wafer and thereby deposit a first plated sublayer electrolytically on the wafer;

forming a second plated sublayer over the first plated sublayer by adjusting the conditions within the bath such that a deposition of metal ions is mass transfer limited in an area near an edge of the wafer thereby causing a rate of deposition to be less near the edge of the wafer than in an interior region of the wafer.

2. The method of claim 1 wherein adjusting the conditions comprises reducing a mass transfer rate near the edge of the wafer.

3. The method of claim 1 wherein adjusting the conditions comprises increasing the current flow to a second current density greater than the first current density.

4. The method of claim 3 wherein the first current density is between 5.25 mA/cm$^2$ and 16.75 mA/cm$^2$ and the second current density is between 33.5 mA/cm$^2$ and 60 mA/cm$^2$.

5. The method of claim 1 wherein adjusting the conditions comprises increasing the current flow to a second current density greater than the first current density and reducing a mass transfer rate near the edge of the wafer.

6. The method of claim 1 wherein the first plated sublayer has a concave upper surface.

7. The method of claim 1 wherein adjusting the conditions within the bath such that a deposition of metal ions is mass transfer limited in an area near an edge of the wafer comprises creating a stagnant zone of the solution near the edge of the wafer.

8. The method of claim 7 comprising causing the solution to flow upwards towards a center of the wafer and then radially outward and across the wafer.

9. The method of claim 1 wherein adjusting the conditions within the bath such that a deposition of metal ions is mass transfer limited in an area near an edge of the wafer comprises positioning a flange over the edge of the wafer.

* * * * *